United States Patent [19]

Stewart

[11] 4,034,989

[45] July 12, 1977

[54] GOLF BALL PUTTER

[76] Inventor: Aubrey P. Stewart, 801 Grove Ave., Corning, Iowa 50841

[21] Appl. No.: 633,967

[22] Filed: Nov. 21, 1975

[51] Int. Cl.[2] ..... A63B 53/04

[52] U.S. Cl. ..... 273/164

[58] Field of Search ..... 273/77 R, 163 R, 164, 273/167–175, 183 D, 183 E, 193 R, 194 R, 194 A; D34/5 GH

[56] References Cited

U.S. PATENT DOCUMENTS

| | | | |
|---|---|---|---|
| 1,485,272 | 2/1924 | Kinsman | 273/164 |
| 1,589,926 | 6/1926 | Beamer | 273/167 G |
| 1,678,750 | 7/1928 | Swan | 273/164 |
| 2,859,972 | 11/1958 | Reach | 273/164 |
| 3,194,564 | 7/1965 | Swan | 273/164 X |
| 3,384,376 | 5/1968 | Greenlee | 273/163 R X |
| 3,392,977 | 7/1968 | De Lacey | 273/164 X |
| 3,806,129 | 4/1974 | Burrows | 273/163 R X |
| 3,921,984 | 11/1975 | Winter | 273/164 |
| D. 200,416 | 2/1965 | Leeah | 273/164 X |
| D. 209,294 | 11/1967 | Hitt | 273/164 X |
| D. 229,844 | 1/1974 | Pavelle | 273/164 X |

*Primary Examiner*—Richard J. Apley

*Attorney, Agent, or Firm*—Wegner, Stellman, McCord, Wiles & Wood

[57] ABSTRACT

The present invention provides a golf putter having a pair of horizontally spaced sights on the back face of the club head, with the sights diverging outwardly and rearwardly, the arrangement being such that the forward projection of the sights converges at a point spaced several feet in front of the putter.

5 Claims, 5 Drawing Figures

GOLF BALL PUTTER

BACKGROUND OF THE INVENTION

One of the most difficult ad often most exasperating parts of a golf game is the putting. Strength plays little or no part in successful putting, and there are innumerable stances and grips adopted by golfers, professional and amateur alike, in an effort to improve this important part of the game.

Some of the better putters have adopted a system wherein, after having determined the line along which they wish the ball to roll, pick a spot a couple of feet in front of the ball. This spot is chosen so that if the putter successfully rolls his ball over that spot, the ball is on the correct line to the hole. The location of this spot will differ with the "break" of the green and thus is not always on a direct line between the ball and the hole. Once having chosen the spot over which the ball is to roll, the next problem of course is to strike the ball in a fashion to result in the ball taking the desired path over the chosen spot and into the hole.

BRIEF SUMMARY OF THE INVENTION

The present invention is designed to provide an alignment aid which helps the golfer line up the putter so that the ball, when struck, will roll over the spot chosen as described in the preceding section. To this end, the back of the putter club head is provided with a pair of horizontally spaced sights which diverge outwardly and rearwardly from the club head. The sights are arranged so that when projected forward, they will visually converge at a point a couple of feet ahead of the ball, preferably about two feet. Thus, if the golfer chooses a spot over which he wishes the ball to roll when putted, and such a spot is about 2 feet from the ball, the sights by converging on that point substantially aid the golfer in correctly aligning the club face. The sights, of course, may take many forms, several of which will be described in detail.

DESCRIPTION OF THE PREFERRED EMBODIMENT

Figure 1:
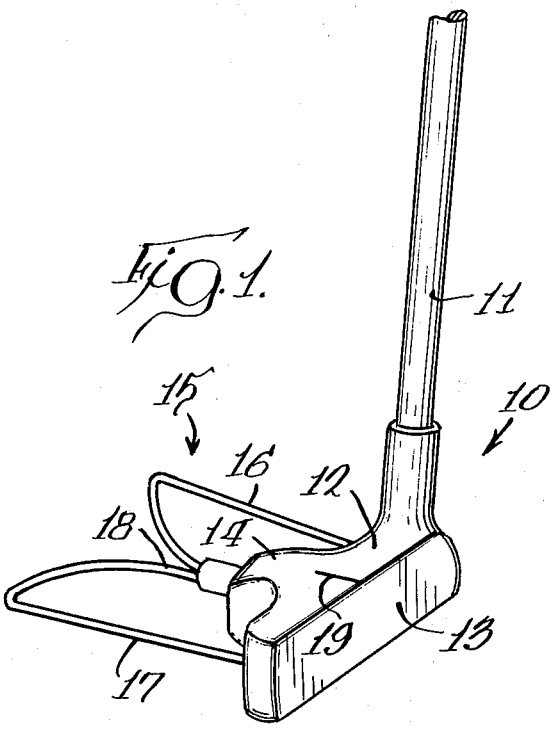
FIG. 1 is an elevational view of the lower end of a putter embodying the invention.
Figure 2:
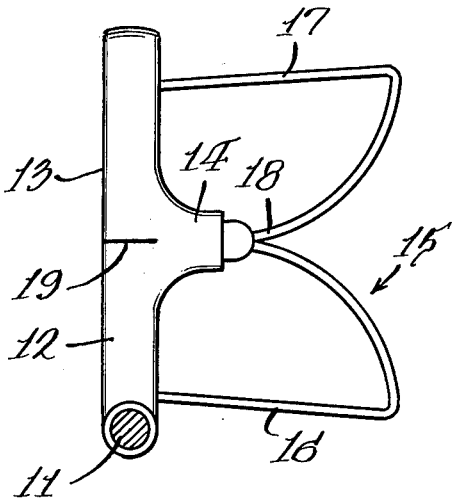
FIG. 2 is a top plan view, partly in section, of the putter shown in FIG. 1.

Referring now to FIGS. 1 and 2 of the drawings, there is shown a putter 10 provided with a shaft 11 fastened at one end to a putter head 12. The putter has a flat face 13 which is the striking face of the club, and in the particular form shown in FIGS. 1 and 2, the head is provided with an outwardly bowed extension 14 on the rear face of the club head. The alignment aid of the embodiment shown in FIGS. 1 and 2 comprises an M-shaped member 15 whose legs 16 and 17 form sighting portions for the purposes hereinbefore described. The portions 16 and 17 are secured to the back side of the club head and diverge outwardly and rearwardly from the club head. The center section 18 of the M-shaped member is secured to the integral portion 14 of the club head. If desired, a sighting line 19 may be provided on the top face of the club head.

Figure 5:
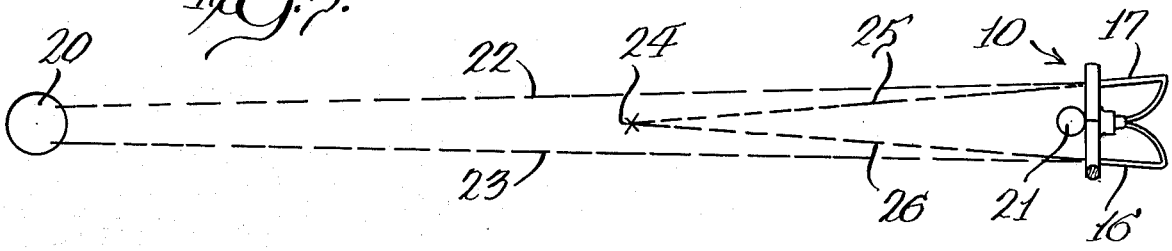
FIG. 5 is a top plan view like FIG. 2 and showing a portion of putting green and a golf hole therein.

Referring to FIG. 5, there is shown a golf hole 20 into which the golfer wishes to putt the golf ball 21. In sighting the shot, the golfer is often told to imagine a pair of railroad tracks 22 and 23 extending from the putter face to the hole and the golfer is cautioned to bring the putter back along the track and forward along the track in order to strike the ball in the proper direction. This may be sound advice where the ball is close to the hole, but where, when standing over the ball and with his eyes fastened on the ball the golfer finds the hole is outside of his peripheral vision, it becomes quite difficult if not impossible to imagine a railroad track extending all the way to a point which is out of his vision.

As pointed out hereinbefore, many first-class golfers in lining up a putt will choose a point or spot a few feet ahead of the ball over which he wishes to roll the ball in order to get it to the cup. In utilizing the putter of the present invention, such a point 24 is chosen so that a projection of the sights 16 and 17 will extend along the lines 25 and 26 and converge on the point 24. The converging lines 25 and 26 are, of course, imaginary and formed in the mind of the golfer, while the point 24 may be a spot on the green or some other identifiable feature.

I have found that the use of the sights 16 and 17 converging as they do in a forward direction, greatly simplifies the task of correctly aligning the putter face 13 so that the ball, when struck, will pass over the spot 24. While the reason this occurs is obscure, the human mind seems capable of sensing the alignment of the imaginary convergences 25 and 26 when provided with the assistance of the sights 16 and 17, and putting skill substantially improves.

As a further feature, the M-shaped member 15 if formed of wire of about ⅛ in. diameter, will vibrate if the ball is struck off-center and produce an audible humming sound. Thus, it the ball is struck squarely, no such hum is generated but if the golfer fails to bring the club head back and forth along one line and thus strikes the ball off-center, he can definitely hear a humming sound which will signal his error.

As indicated earlier, the sights 16 and 17 can take many forms. For example, in FIG. 3 the putter is provided with a shaft 31, a club head 32, having a front face 33 and a rear face 34. A pair of sights 36 and 37 extend rearwardly from the club face and diverge outwardly as shown. The sights 36 and 37 may be tipped with balls 38 and 39 to guard against injury.

Figure 4:
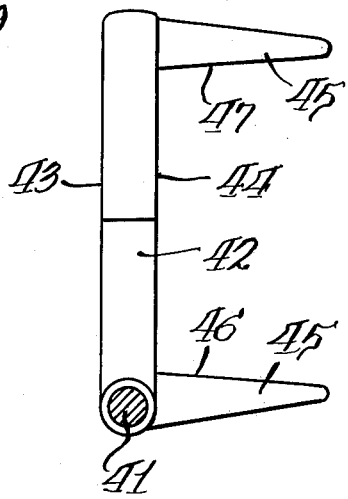
FIG. 4 is a view like FIG. 2 of a further modification of the invention.

Similarly, in FIG. 4 the putter is provided with a shaft 41 attached to a club head 42 which has a front face 43 and a rear face 44. Extending rearwardly from the face 44 is a pair of sighting members 45, each of which has an outwardly diverging sighting portion indicated at 46 and 47.

Figure 3:
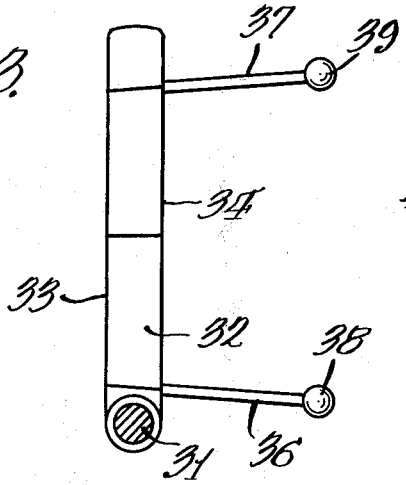
FIG. 3 is a view like FIG. 2 of a modified form of the invention.

The putters of FIGS. 3 and 4 are used in the same manner as the putter of FIG. 1, although the audible humming previously mentioned does not seem apparent.

I claim:

1. In combination with a putter having a shaft secured to a head with the head having a flat front face for striking a golf ball, an alignment aid comprising a horizontally arranged generally M-shaped member secured to the back of the head with the legs of the member forming spaced sighting portions diverging outwardly and rearwardly from the head, the arrangement being such that a projection of said sighting portions forwardly converges at a point several feet in front of said face.

2. In combination with a putter having a shaft secured to a head with the head having a flat front face for striking a golf ball, an alignment aid comprising a horizontally arranged generally M-shaped member formed of wire of approximately ⅛ inch diameter and secured to the back of the head with the legs of the member forming spaced sighting portions diverging outwardly ad rearwardly from the head, the arrangement being such that a projection of said sighting portions forwardly converges at a point several feet in front of said face.

3. In combination with a putter having a shaft secured to a head with the head having a flat front face for striking a golf ball, an alignment aid comprising a pair of spaced, round, wire-like metal members secured to and diverging outwardly from the back of the head, the arrangement being such that a projection forwardly of said members converges at a point approximately two feet in front of said face.

4. In combination with a putter having a shaft secured to a head with the head having a flat front face for striking a golf ball, an alignment aid comprising a pair of horizontally spaced members extending rearwardly from said face, each of said spaced members being entirely elongate, substantially straight member with its entire peripheral surface diverging outwardly from the head, the arrangement being such that a forward projection of said members converges at a point approximately two feet in front of said face.

5. In combination with a putter having a shaft secured to a head with the head having a flat front face for striking a golf ball, an alignment aid comprising a pair of spaced, round, wire-like metal members secured to and diverging outwardly from the back of the head, the arrangement being such that a projection forwardly of said members converges at a point approximately two feet in front of said face and said metal members have outwardly extending tips upon which ball means are mounted to guard against injury.

* * * * *